United States Patent [19]

Watts et al.

[11] Patent Number: 4,550,827

[45] Date of Patent: Nov. 5, 1985

[54] TIRE PACKAGING

[75] Inventors: George T. Watts, North Canton; Theron J. Thaden, Cuyahoga Falls, both of Ohio

[73] Assignee: The Goodyear Tire & Rubber Company, Akron, Ohio

[21] Appl. No.: 680,222

[22] Filed: Dec. 10, 1984

Related U.S. Application Data

[63] Continuation of Ser. No. 487,431, Apr. 21, 1983, abandoned.

[51] Int. Cl.[4] ..... B65D 85/06

[52] U.S. Cl. ..... 206/304; 206/303; 206/586; 229/87 T; 152/379.4

[58] Field of Search ..... 206/303, 304, 523, 586; 229/87 T; 152/185.1, 186, 188, 379.3, 379.4, 396, 397; 301/63 PW

[56] References Cited

U.S. PATENT DOCUMENTS

| | | | |
|---|---|---|---|
| 1,058,029 | 4/1913 | Besse | 152/186 |
| 1,510,159 | 9/1924 | Powell | 206/304 |
| 1,612,601 | 12/1926 | Bayona | 152/186 |
| 1,930,585 | 10/1933 | Covey | 152/186 |
| 2,535,299 | 12/1950 | Leach et al. | 152/186 |
| 3,357,554 | 12/1967 | Walter | 206/303 |
| 3,876,069 | 4/1975 | Studen | 206/304 |
| 4,013,099 | 3/1977 | Gerigk et al. | 206/303 |

*Primary Examiner*—Joseph Man-fu Moy
*Assistant Examiner*—David T. Fidei
*Attorney, Agent, or Firm*—L. R. Drayer

[57] ABSTRACT

There is disclosed a plastic bead protector and a method of packaging large tires having bead portions that are susceptible to damage by lifting hooks or fork trucks during shipment. The bead protectors are slideably inserted inside of the bead portions of a tire and are retained in position by a plurality of elastic tension members.

4 Claims, 3 Drawing Figures

TIRE PACKAGING

This application is a continuation of application Ser. No. 487,431, filed Apr. 21, 1983, now abandoned.

BACKGROUND OF THE INVENTION

This invention relates generally to tire packaging, and more specifically to the packaging of large tires having beads that are susceptible to damage by lifting hooks or fork trucks during shipment.

It is widely recognized in the tire and shipping industries that tires for heavy equipment having, for example, nominal bead diameters of 508 millimeters (20 inches) and larger are very susceptible to damage when they are handled by fork trucks or lifting hooks during shipment. The use of such handling equipment is necessitated by the heavy weights of these tires which can typically range from about 225 kilograms (500 pounds) to about 6,800 kilograms (15,000 pounds). Damage frequently occurs to the bead portions of the tire because the fork truck forks, or lifting hook, pick up the tire by the bead portions.

Tire manufacturers have made various attempts at packaging tires for heavy equipment to prevent or minimize damage to the bead portions of tires during shipment, but each of the prior art tire packages has its own drawbacks. One packaging approach has been the use of wooden disks having diameters larger than the beads of a tire located on each side of the tire and fastened to one another by straps. While the disk approach does protect the inside of the tire as long as the disks remain intact, there is no hole in the disk for fork lift handling and the packaging is expensive. Furthermore fork lift operators have often punctured or removed the disks to facilitate handling and damage results to the tire. Another approach has been to place extruded rubber tubes slit to form U-shaped channels around the bead portions of a tire, place axially oriented wood spacers between the beads, and staple straps extending radially around and through the tire to the wooden spacers. This packaging is difficult to install, expensive because it is very labor intensive, and can result in tire damage if the wooden spacers split during shipment. Yet another approach has been the use of a metal rim base/flange with foam rubber or styrofoam padding between the metal rim base/flange and the tire bead; one metal rim base/flange is used for each tire bead, and they are connected to one another by tension members. This last approach is not only expensive, but can result in damage to the tire if the metal rim base/flange is kinked or distorted resulting in a rough edge during handling because the metal is not flexible or elastic enough to distort with the tire beads during handling and then return to its original shape when the tire bead does.

The expense of the packaging approaches described above is an important consideration because tires for heavy equipment are frequently shipped to distant countries making the return of the packaging materials to the tire manufacturer for re-use impractical. Of course, even if the tires are shipped a shorter distance the re-use of the packaging material is minimized by the frequent occurrence of damage to the packaging as has already been described.

A plastic bead protector and a tire package according to the present invention overcome the problems of high cost, difficult installation, and inadequate protection of the tire bead portions of prior art packaging. The reduced weight of a plastic bead protector and tire package according to the present invention, in respect to the prior art packaging, also contributes to reduced shipping costs.

BRIEF DESCRIPTION OF THE DRAWINGS

Various advantages and features of the invention will be apparent in the following description and claims, considered together with the drawings forming an integral part of the specification and in which:

DETAILED DESCRIPTION OF THE INVENTION

Figure 1:
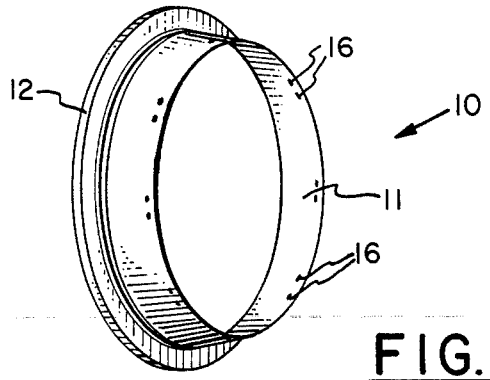
FIG. 1 is a perspective view of a bead protector according to the invention.

Referring first to FIG. 1, there is shown a perspective view of a bead protector 10 for use in packaging a tire. The bead protector 10 of FIG. 1 is intended to be used for protecting the bead portions of a tire having a conventional horseshoe shaped radial cross-section such as that illustrated in radial cross-section in FIG. 2.

Figure 2:
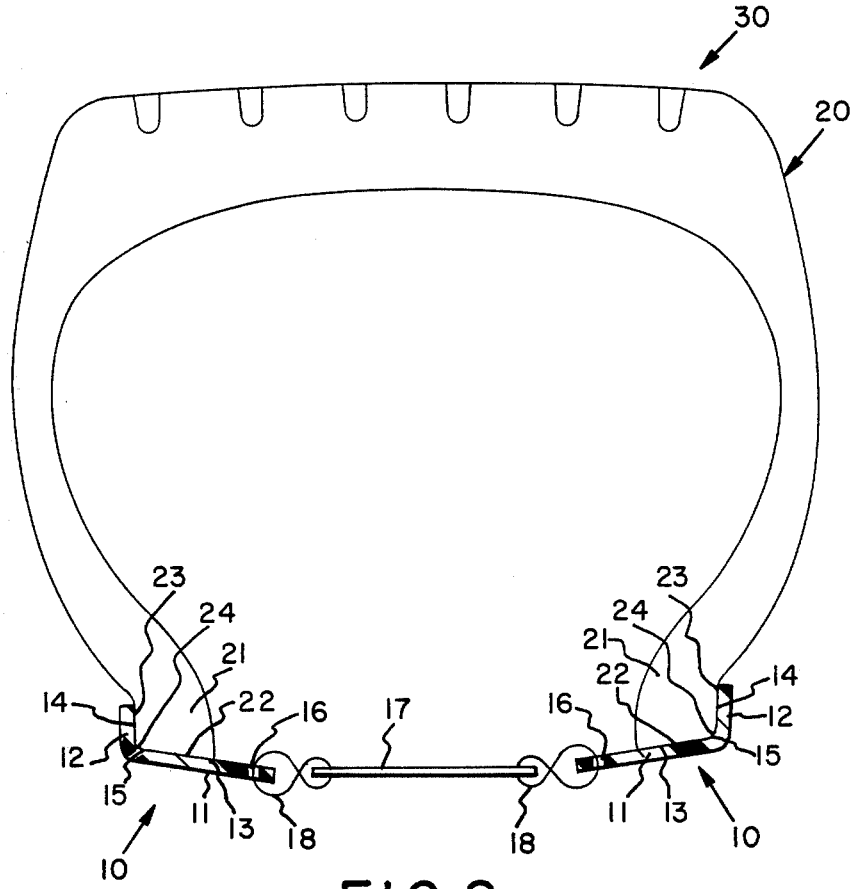
FIG. 2 is a radial cross-sectional view of a tire package according to one aspect of the invention.

The tire 20 illustrated in FIG. 2 has a pair of annular bead portions 21. Each annular bead portion 21 of the tire has a radially inner surface 22 of a predetermined axial width that is oriented at a predetermined angle with respect to the axis of rotation of the tire. Each bead portion 21 also has an axially outer surface 23 that extends in a generally radial direction. The radially inner and axially outer surfaces of each bead portion are connected to one another by a curved surface 24. Projections of the radially inner and axially outer surfaces of the bead portions of the tire intersect one another at the predetermined sharp diameter of the bead portions. The sharp diameter of the bead portion of a tire, rounded to the nearest one-half inch, is often referred to in the tire art as the nominal bead diameter of a tire. The dimensions and orientation of the surfaces of the bead portion of a tire are selected by a tire engineer in accordance with well known engineering practices so that the bead portions will mate properly with a rim that the tire is designed to be mounted upon. While it is believed that the present invention may be most advantageously practiced in cooperation with tires for heavy equipment, such as earthmovers, having, for example, nominal bead diameters in the range of from about 508 millimeters (20 inches) to about 1,450 millimeters (57 inches), it is understood that any tire fitting the above general description may be protectively packaged according to the invention regardless of its size.

As used herein and in the appendend claims "axis" refers to the axis of rotation about which a tire, tire package or bead protector may normally rotate, and "axial" and "axially" refer to directions parallel to said axis. "Radial" and "radially" refer to directions that are perpendicular to said axis.

A bead protector 10 according to the invention can best be described by referring to FIG. 1 in conjunction with FIG. 2, which is a radial cross-sectional view of a tire package according to one aspect of the invention. The bead protector 10 is an annular plastic structure comprising a bead seat 11 extending in a generally axial direction with a generally radially extending flange 12 located at one axial end of the bead seat. The bead seat 11 of the bead protector 10 has a radially outer surface 13 with an axial width that is preferably at least as great as the axial width of the radially inner surfaces 22 of the bead portions of a tire that the bead protector is intended to protect. The radially outer surface 13 of the bead seat 11 of the bead protector is oriented at substantially the same angle with respect to the axis of the bead protector as the radially inner surfaces 22 of the bead portions of the tire are oriented with respect to the axis of rotation of the tire. It is understood that in a tire package according to the invention the tire and the bead protectors are coaxial. These surfaces are normally oriented at angles of between about 5° and about 15° with respect to their respective axes, so that the bead seat 11 has one axial end that is located radially outwardly of the other axial end of the bead seat. The flange 12 of the bead protector is located at the radially outermost axial end of the bead seat.

The radially outer surface 13 of the bead seat 11 and the axially inner surface 14 of the flange 12 are connected by a curved surface 15, and projections of each of these surfaces intersect one another at a sharp diameter that is equal to or less than the sharp diameter of the bead portions of the tire. Preferably the difference between the sharp diameter of the bead portions of the tire and the sharp diameter of the bead protector is no greater than 3.175 millimeters ($\frac{1}{8}$ inch). Put another way, the difference between the two sharp diameters should be in the range of 0.0 to 3.175 millimeters ($\frac{1}{8}$ inch) so that the bead protector can be slideably inserted inside the bead portion of the tire and still have relatively little movement in a radial direction that could eventually result in the distortion of the protector when the tire is handled during shipping.

The radial height of the flange 12 of the bead protector should preferably be about the same as that of the radially oriented portion of the side protecting flange of a rim that the tire is designed to be mounted upon, but in any event it must be long enough to extend radially outwardly of the curved surface 24 at the heel of the bead portion of the tire when the bead protector is inserted into the bead portion of a tire.

Preferably a plastic bead protector according to the invention is comprised of polyethylene. Bead protectors according to the invention have been satisfactorily manufactured by rotational molding of Medium-Density Polyethylene Rotational Molding Resin DNDA-7148 Natural, which is distributed by the Union Carbide Corporation. Bead protectors manufactured using this particular resin performed satisfactorily when they were manufactured to be between about 6.35 millimeters ($\frac{1}{4}$ inch) and about 9.52 millimeters ($\frac{3}{8}$ inch) thick. Plastic bead protectors of this construction had both sufficient strength and flexibility to protect and distort with the tire without breaking or becoming displaced when handled by fork trucks or lifting hooks during shipping. Furthermore these bead protectors, and the tire package, are much less expensive than the prior art tire packages described herein. However, it is understood that a bead protector according to the invention may be made of any flexible plastic material and by any manufacturing method without deviating from the scope of the invention.

A tire package according to the invention comprises a tire of the type that has already been described with reference to FIG. 2, a pair of annular plastic bead protectors as had already been disclosed with reference to FIGS. 1 and 2, and a plurality of elastic tension members exerting an axially inwardly directed force on each of the bead protectors to hold them in position with respect to the bead portions of the tire. Referring now to FIG. 2, a tire package 30 according to the invention is manufactured by providing a tire 20 of the type already described; slideably inserting a plastic bead protector 10 inside of each bead portion 21 of the tire such that the radially outer surface 13 of the bead seat 11 of the bead protector is adjacent to the radially inner surface 22 of a bead portion of the tire and the axially inner surface 14 of the flange 12 of the bead protector is adjacent to the axially outer surface 23 of the bead portion of the tire. Preferably the radially outer surface of the bead seat of each bead protector has an axial width that is greater than the axial width of the radially inner surfaces of the bead portions of the tire, as shown in FIG. 2, and the bead seats have a plurality of circumferentially spaced apart holes 16 therethrough. The holes 16 are disposed at an axial distance from the axially inner surface of the flange that is greater than the axial width of the radially inner surfaces of the bead portions of the tire. An elastic tension member 17, such as a strip of inner tube or a spring, is then secured to each of the bead protectors by a means for fastening 18, such as an S hook, that extends through one of said holes. If the means for fastening are S hooks it is preferable that they be crimped shut, as shown in FIG. 2.

Figure 3:
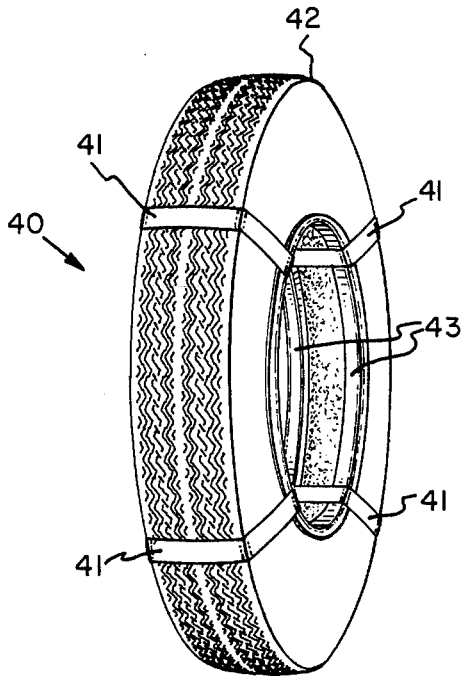
FIG. 3 is a perspective view of a tire package in accordance with another aspect of the invention.

A tire package according to another aspect of the invention may also be manufactured as illustrated in FIG. 3, even if the radially outer surfaces of the bead seats of the bead protectors are not as wide as, or wider than, the radially inner surfaces of the bead portions of the tire. The elastic tension members 41 may be straps that extend completely around and through the tire 42 and bead protectors 43 in a plane that is substantially perpendicular to the axis of rotation of the tire package 40.

While certain representative embodiments and details have been shown for the purpose of illustrating the invention, it will be apparent to those skilled in the art that various changes and modifications may be made therein without departing from the spirit or scope of the invention.

What is claimed is:

1. A tire package having an axis of rotation and comprising:

a. an uninflated tire having a pair of annular bead portions, each said bead portion having a radially inner surface of a predetermined axial width that is oriented at a predetermined angle of between about 5° and about 15° with respect to said axis, each said bead portion further comprising an axially outer surface extending in a generally radial direction, projections of the radially inner and axially outer surfaces of said bead portions intersecting one another at the sharp diameter of the bead portions;

b. a pair of annular plastic bead protectors, each of said bead protectors being slideably inserted inside a bead portion of said tire, each said bead protector comprising an annular bead seat with a generally radially extending flange located at the axially outermost end of the bead seat with respect to said tire package, the bead seat of each bead protector having a radially outer surface that is adjacent to the radially inner surface of a bead portion of said tire with the flange having an axially inner surface that is adjacent to the axially outer surface of the bead portion of the tire, the radially outer surface of the bead seat of each bead protector being oriented at substantially the same angle with respect to said axis as the radially inner surfaces of the bead portions of said tire, projections of the radially outer surfaces of said bead seats and axially inner surfaces of said flanges intersecting one another at a sharp diameter that is in the range of 0.0 to 3.75 millimeters less than the sharp diameter of the bead portions of said tire; and c. a plurality of elastic tension members exerting an axially inwardly directed force on each of said bead protectors.

2. A tire package as described in claim 1 wherein the radially outer surface of the bead seat of each bead protector has an axial width that is greater than the axial width of the radial inner surfaces of the bead portions of said tire, the bead seat of each bead protector having a plurality of circumferentially spaced apart holes extending therethrough located axially inwardly of the radially inner surface of the respective bead portion of said tire, and said elastic tension members being secured to each of said bead protectors by a means for fastening that extends through one of said holes.

3. A tire package as described in claim 1 wherein said bead protectors are comprised of polyethylene.

4. A tire package as described in claim 2 wherein said bead protectors are comprised of polyethylene.

* * * * *

UNITED STATES PATENT OFFICE

CERTIFICATE OF CORRECTION

PATENT NO. : 4,550,827

DATED : November 5, 1985

INVENTOR(S) : George T. Watts, Theron J. Thaden

It is certified that error appears in the above-identified patent and that said Letters Patent are hereby corrected as shown below:

The following References were cited by the Examiner and should appear on the front page of the printed patent.

| | | | | |
|---|---|---|---|---|
| 2,874,829 | 2/1959 | Shaw | 206 | 304 |
| 3,106,951 | 10/1963 | Hurdel | 152 | 379.3 |
| 3,913,653 | 10/1975 | Verdier | 152 | 379.3 |
| 3,983,918 | 10/1976 | French | 152 | 379.3 |
| 4,151,870 | 5/1979 | Watts | 152 | 379.3 |
| 4,325,422 | 4/1982 | Corner et al. | 152 | 396 |
| 4,483,729 | 11/1984 | Futisaki et al. | 301 | 63PW |

Signed and Sealed this

*Twenty-seventh* Day of *May 1986*

[SEAL]

*Attest:*

DONALD J. QUIGG

*Attesting Officer*

*Commissioner of Patents and Trademarks*